US007032405B2

(12) United States Patent
Hwang

(10) Patent No.: US 7,032,405 B2
(45) Date of Patent: Apr. 25, 2006

(54) APPARATUS FOR FIXING PRINTED CIRCUIT BOARD OF REFRIGERATOR

(75) Inventor: Jung-Kqu Hwang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/695,738

(22) Filed: Oct. 30, 2003

(65) Prior Publication Data

US 2004/0089013 A1 May 13, 2004

(30) Foreign Application Priority Data

Oct. 31, 2002 (KR) ..... 10-2002-0067259

(51) Int. Cl.
*F25D 19/00* (2006.01)

(52) U.S. Cl. ..... 62/298; 62/259.1

(58) Field of Classification Search ..... 62/259.2, 62/298, 302, 259.1

See application file for complete search history.

(56) References Cited

U.S. PATENT DOCUMENTS 4,854,721 A * 8/1989 Hume ..... 366/340
5,272,888 A * 12/1993 Fisher et al. ..... 62/344
5,842,355 A * 12/1998 Kalis et al. ..... 62/234
6,286,324 B1 * 9/2001 Pastryk et al. ..... 62/137

FOREIGN PATENT DOCUMENTS

| | | | |
|---|---|---|---|
| DE | 9319693 | U1 | 5/1994 |
| DE | 19746953 | A1 | 5/1998 |
| DE | 19812334 | A1 | 9/1999 |
| DE | 29819357 | U1 | 4/2000 |

OTHER PUBLICATIONS

German Office Action dated Feb. 21, 2005 w/English Translation.

* cited by examiner

*Primary Examiner*—Melvin Jones
(74) *Attorney, Agent, or Firm*—Fleshner & Kim, LLP

(57) ABSTRACT

An apparatus is provided which eases the installation and removal of a printed circuit board for a refrigerator. A support plate is fixed to either a lower portion or a side portion of the main body of the refrigerator. The support plate includes a receiving portion, which receives and properly positions the printed circuit board in the support plate so that a connection terminal of the printed circuit board is easily mated with a power terminal of the refrigerator when the board is inserted. Guide protuberances may be formed in the receiving portion to ease the sliding motion of the board relative to the support plate. The board may be easily removed and replaced by simply sliding the board into and out of the receiving portion, thus improving ease of use and facilitating repair.

25 Claims, 4 Drawing Sheets

APPARATUS FOR FIXING PRINTED CIRCUIT BOARD OF REFRIGERATOR

BACKGROUND OF THE INVENTION

1. Field of the Invention

The present invention relates to an apparatus for fixing a printed circuit board of a refrigerator, and more particularly, to an apparatus for fixing a printed circuit board of a refrigerator installed at a main body of a refrigerator so as to control a refrigeration function.

2. Description of the Background Art

Lately, as a refrigerator is multifunctionalized, a size and an installation position of a printed circuit board for controlling a refrigeration function is importantly considered.

FIG. 1 is a perspective view showing a conventional refrigerator.

As shown therein, at the conventional refrigerator, a fixing apparatus 10 covering a printed circuit board 2 is coupled with an upper portion of the refrigerator main body 1 (or rear surface thereof) by bolts 11. At a lower portion of the refrigerator main body 1, a lower cover 3 is installed.

However, in the conventional refrigerator, the fixing apparatus 10 is installed at the upper portion of the refrigerator main body 1 (or a rear surface), and the printed circuit board 2 is mounted in the fixing apparatus 10. For this reason, in case of repairing or replacing the printed circuit board, since bolts 11 have to be fully unthreaded in order to disassemble the fixing apparatus 10, it is difficult to repair and replace the board 2, and it takes much time to complete the work.

SUMMARY OF THE INVENTION

Therefore, an object of the present invention is to provide an apparatus for fixing a printed circuit board of a refrigerator capable of being easily and conveniently replaced and repaired without moving a refrigerator main body since the printed circuit board is slid to be coupled with and separate from the inside of a support plate fixed at a lower portion of the refrigerator main body, To achieve these and other advantages and in accordance with the purpose of the present invention, as embodied and broadly described herein, there is provided an apparatus for fixing a printed circuit board of a refrigerator according to the present invention includes a support plate installed at a lower portion of a refrigerator main body so as to slidably receive the printed circuit board; and a support plate coupling means for fixing the support plate to the lower portion of the refrigerator main body.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
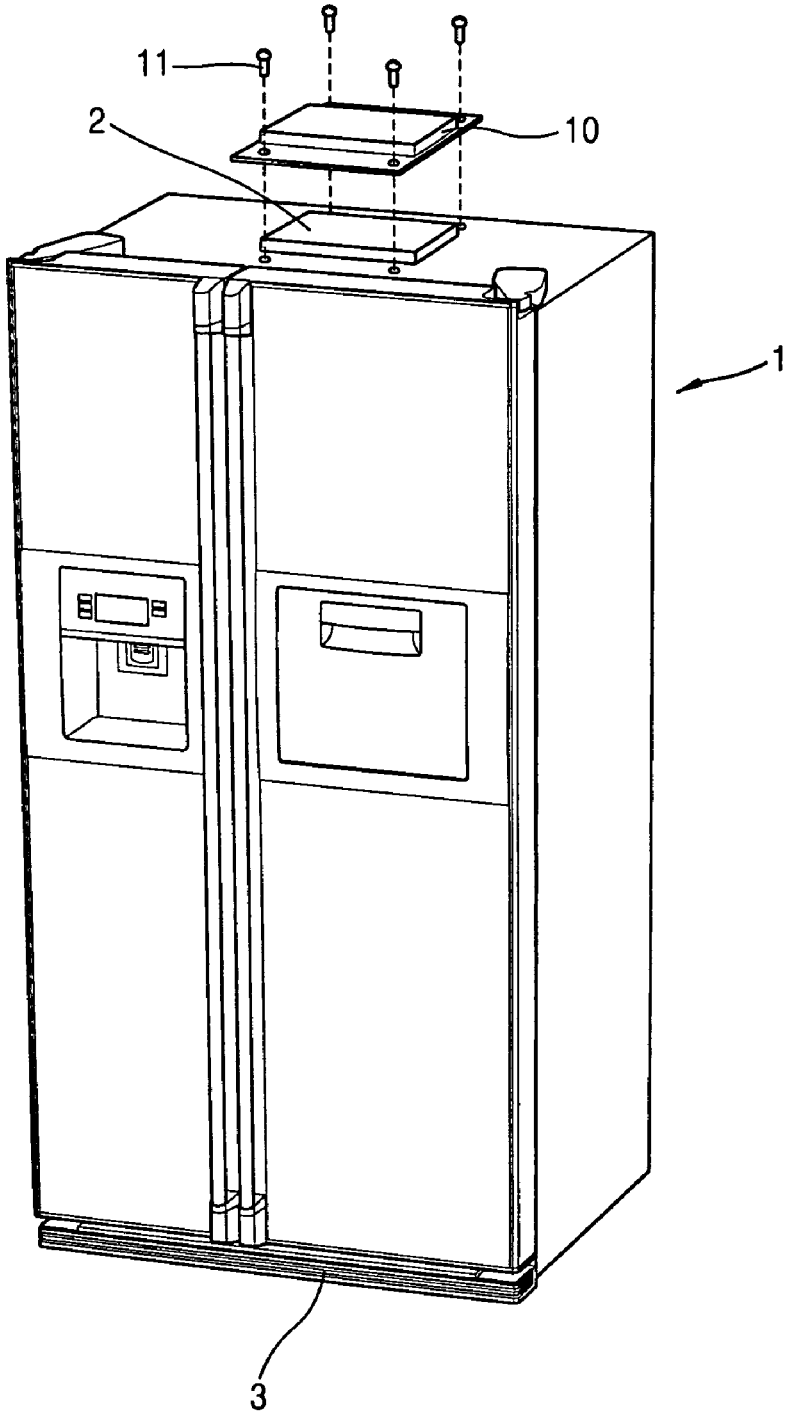
FIG. 1 CONVENTIONAL ART
FIG. 1 is a perspective view showing a conventional refrigerator.
Figure 2:
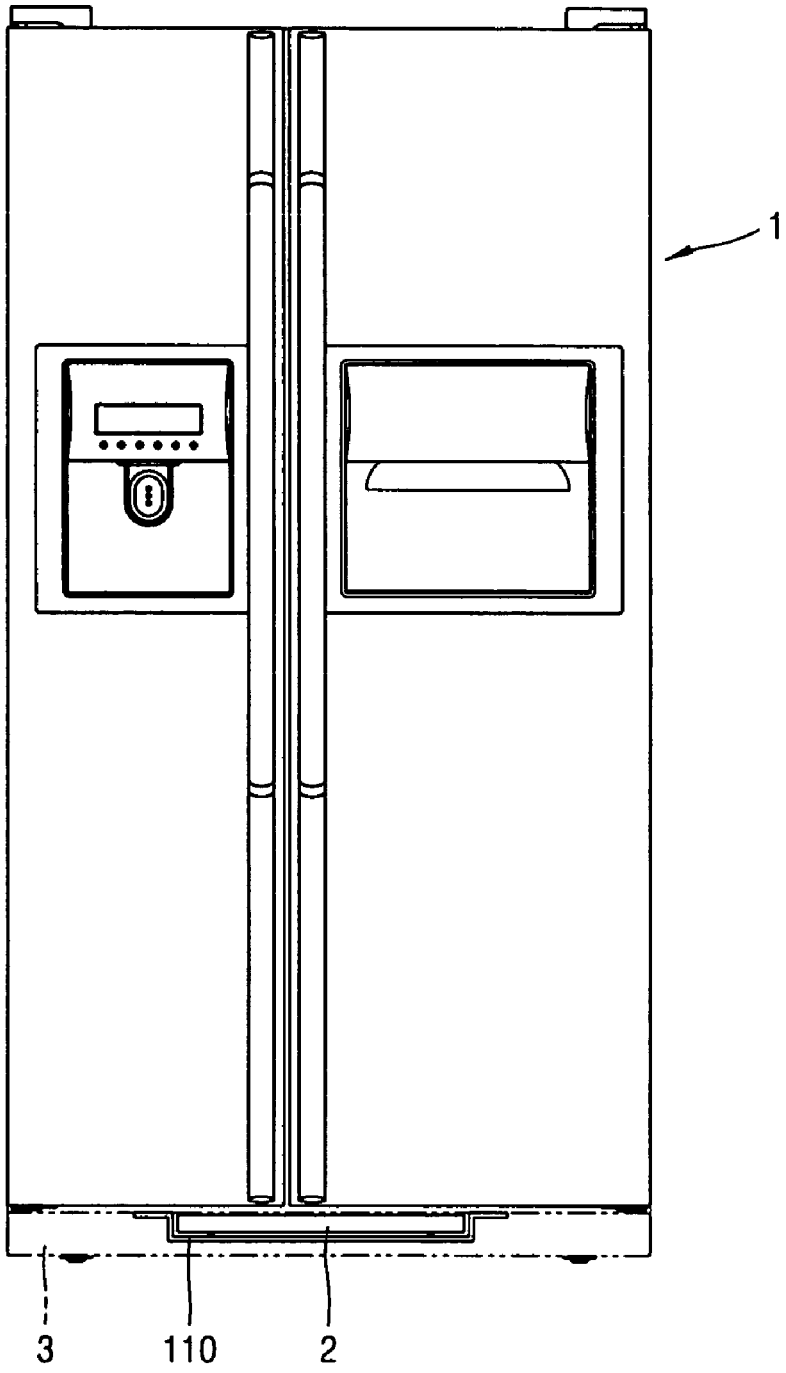
FIG. 2 is a front view showing installation of an apparatus for fixing a printed circuit board of a refrigerator according to the present invention.
Figure 3:
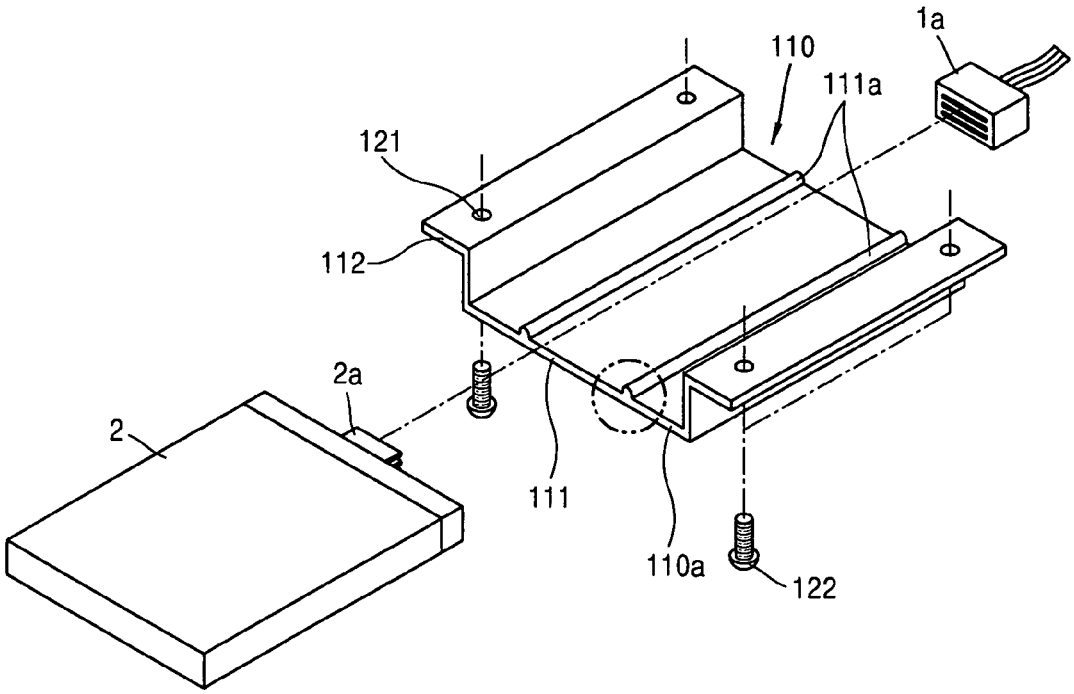
FIG. 3 is a disassembled perspective view showing an apparatus for fixing a printed circuit board of a refrigerator according to the present invention.
Figure 4:
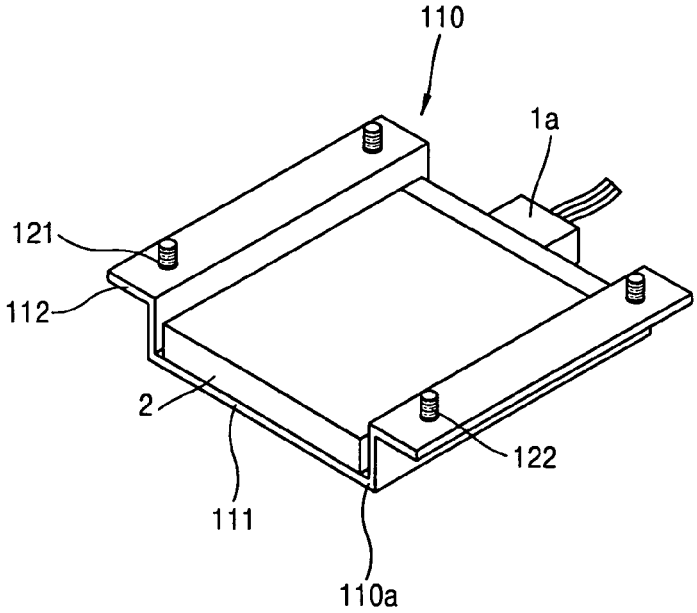
FIG. 4 is an assembled perspective view showing an apparatus for fixing a printed circuit board of a refrigerator according to the present invention.
Figure 5:
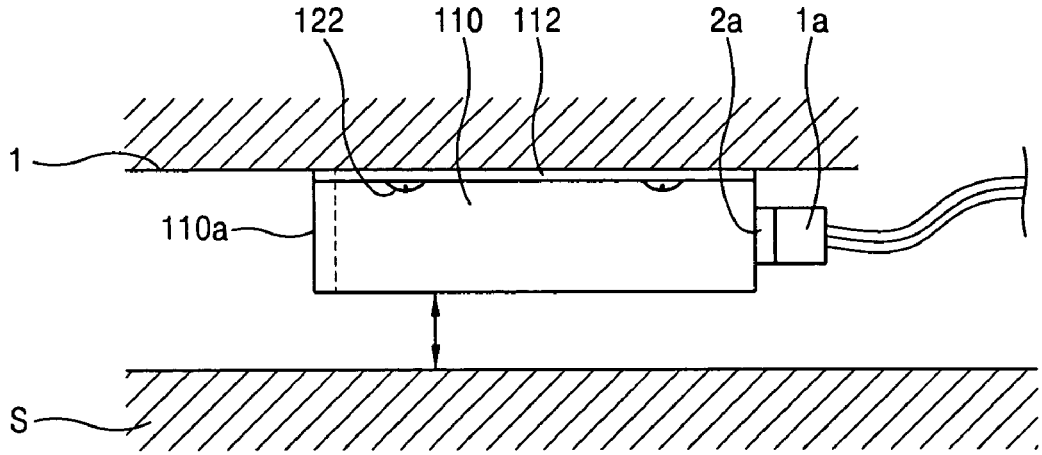
FIG. 5 is a side view showing an apparatus for fixing a printed circuit board of a refrigerator according to the present invention.
Figure 6:
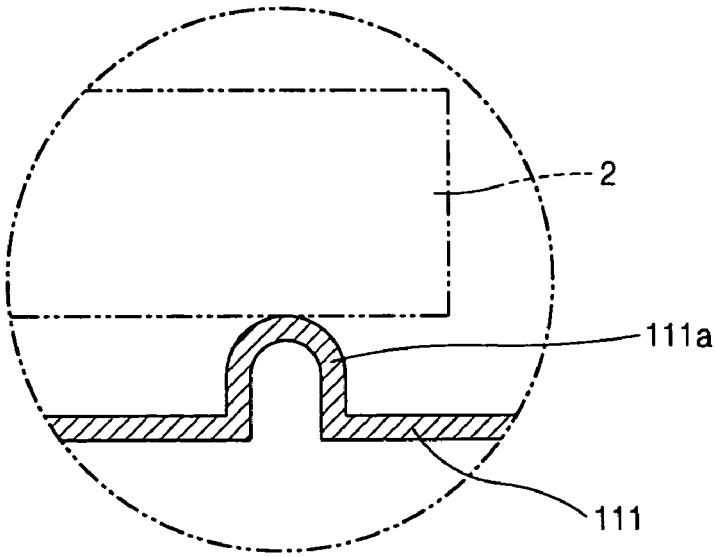
FIG. 6 is an enlarged longitudinal sectional view showing a main part.

FIG. 2 is a front view showing installation of an apparatus for fixing a printed circuit board of a refrigerator according to the present invention. FIG. 3 is a disassembled perspective view showing an apparatus for fixing a printed circuit board of a refrigerator according to the present invention, and FIG. 4 is an assembled perspective view showing an apparatus for fixing a printed circuit board of a refrigerator according to the present invention. FIG. 5 is a side view showing an apparatus for fixing a printed circuit board of a refrigerator according to the present invention, and FIG. 6 is an enlarged longitudinal sectional view showing a main part.

As shown therein, an apparatus for fixing a printed circuit board of a refrigerator according to the present invention includes a support plate 110 installed at a lower portion of a refrigerator main body 1 so as to slidably receive the printed circuit board 2; a bolt hole 121 formed at both sides of the support plate in order to fix the support plate 110 to the refrigerator main body; and a bolt 122 coupled to the bolt hole 121.

The support plate 110 includes a receiving portion 111 where the printed circuit board 2 is received; and a flange portion 112 bent and formed at both sides of the receiving portion 111.

Preferably, the support plate 110 is positioned with an interval of 30 mm between itself and a bottom surface S of the housing, and a surface of the support plate 110 is waterproofed.

At an inner bottom surface of the support plate 110, two guide protrusions 111*a* are formed in a moving direction of the printed circuit board 2.

The guide protrusions 111*a* make movement of the printed circuit board 2 smooth, and, because the guide protrusions 111*a* generate an interval between the printed circuit board 2 and the inner bottom surface of the support plate 110, allow the printed circuit board 2 positioned in the receiving portion 111 of the support plate 110 to be readily and conveniently pulled out.

The printed circuit board 2 is a board where a circuit element for controlling a refrigeration function is integrated. At the back surface of the board, a connection terminal 2*a* is formed.

At an inner surface of a lower portion of the refrigerator main body 1, a power terminal 1*a* corresponding to the connection terminal 2*a* is installed. Accordingly, if the printed circuit board 2 is inserted into the support plate 110, the connection terminal 2*a* of the printed circuit board 2 is automatically connected to the power terminal 1*a*.

At the lower portion of the refrigerator main body 1, a lower cover 3 for covering the support plate 110 is installed. For aesthetic purposes, the lower cover 3 covers the support plate 110, and makes the support plate 110 invisible in a view of the front of the refrigerator main body 1.

Herein, the lower cover 3 is generally installed at the lower portion of the refrigerator main body 1, and is coupled to the main body 1 with a bolt (not shown).

Generally, at the printed circuit board 2, heat is generated, and thus the support plate 110 is heated by this heat. Therefore, the front surface of the support plate 110, which is in contact with cold air within a housing, may be covered with condensation, and thus the printed circuit board 2 may break down since this condensation can cause a short circuit.

In order to prevent this break down, an adiabatic portion 110*a* is formed at a portion at which the lower cover 3 and the support plate 110 are in contact with each other, that is, at the front surface of the support plate 110.

In the apparatus for fixing the printed circuit board of the refrigerator according to the present invention constructed as above, a bolt 122 is coupled at the bolt hole 121 of the flange 112 of the support plate 110. In this manner, the support plate 110 is fixed to the lower portion of the refrigerator main body 1.

When the installation of the support plate 110 is complete, if the printed circuit board 2 is inserted into the receiving portion 111 of the support plate 110, the connection terminal 2*a* is connected to the power terminal 1*a*.

At this time, the printed circuit board 2 is smoothly inserted into the receiving portion 111 of the support plate 110 by the guide protrusion 111*a*.

The lower cover 3 is fixed to the lower portion of the refrigerator main body 1 by a bolt (not shown), and prevents the support plate 110 from being exposed to the outside.

When the printed circuit board 2 is replaced because of degradation and a break down thereof, first of all, a bolt (not shown) is unthreaded, and thus the lower cover 3 is separated from the refrigerator main body 1.

Thereafter, if the printed circuit board 2 is pulled out, using a gap between the printed circuit board 2 and the support plate 110, the printed circuit board 2 is separated from the receiving portion 111 of the support plate 110, and simultaneously, the connection terminal 2*a* is separated from the power terminal 1*a*.

At this time, the printed circuit board 2 is smoothly separated from the receiving portion 111 of the support plate 110 by the guide protrusion 111*a*.

As so far described, in the apparatus for fixing the printed circuit board of the refrigerator according to the present invention, without moving a refrigerator main body, the printed circuit board is slidably coupled with or separated from the inside of the support plate fixed at the lower portion of the refrigerator main body. For this reason, the printed circuit board can be replaced more readily and conveniently.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for fixing a printed circuit board of a refrigerator, comprising:

a support member installed at a lower portion of a refrigerator main body so as to slidably receive a printed circuit board; and a support member coupling means for fixing the support member to the refrigerator main body.

2. The apparatus of claim 1, wherein the support member comprises:

a receiving portion for receiving the printed circuit board therein; and a flange portion bent and formed at both sides of the receiving portion.

3. The apparatus of claim 1, wherein the support member coupling means comprises:

a bolt hole formed at both sides of the support member; and a bolt coupled at the bolt hole.

4. The apparatus of claim 1, further comprising a guide protrusion formed at an inner bottom surface of the support member.

5. The apparatus of claim 4, wherein the guide protrusion is formed in a moving direction of the printed circuit board.

6. The apparatus of claim 1, further comprising a lower cover for covering the support member installed at a lower portion of the refrigerator main body.

7. The apparatus of claim 1, further comprising an adiabatic portion formed at a front surface of the support member.

8. An apparatus for fixing a printed circuit board of a refrigerator, comprising:

a support member installed at one side of a refrigerator main body so as to slidably receive a printed circuit board; and a support member coupling means for fixing the support member to one side of the refrigerator main body.

9. The apparatus of claim 8, wherein the support member comprises:

a receiving portion for receiving the printed circuit board therein; and a flange portion bent and formed at both sides of the receiving portion.

10. The apparatus of claim 9, wherein the support member coupling means comprises:

a bolt hole formed at both sides of the support member; and a bolt coupled at the bolt hole.

11. A refrigerator comprising the apparatus of claim 1.

12. A refrigerator comprising the apparatus of claim 8.

13. A mounting apparatus for a printed circuit board of a product, the apparatus comprising:

a support member configured to be installed on a surface of a main body of the product, and to slidably receive a printed circuit board; and a coupling device configured to couple the support member to the main body of the product.

14. The apparatus of claim 13, wherein the support member is configured to be installed on a side portion of the main body of the product.

15. The apparatus of claim 13, wherein the support member is configured to be installed on a lower portion of the main body of the product.

16. The apparatus of claim 15, further comprising a cover configured to be attached to the main body so as to cover the support member installed at a lower portion of the main body of the product.

17. The apparatus of claim 16, further comprising an adiabatic portion formed at a front surface of the support member.

18. The apparatus of claim 17, wherein the adiabatic portion is formed at a front surface of the support member proximate the cover, and wherein the adiabatic portion is configured to prevent damage to the printed circuit board due to an environmental effect.

19. The apparatus of claim 13, wherein the support member comprises:

a receiving portion configured to slidably receive the printed circuit board therein; and a first flange portion extending from a side of the receiving portion, and a second flange portion extending from an opposite side of the receiving portion, wherein the coupling device is configured to engage with the first and second flange portions so as to secure the support member to the product.

20. The apparatus of claim 19, wherein the coupling device comprises:

at least one hole formed in the first flange portion, and at least one hole formed in the second flange portion; and at least one fastener configured to be coupled to the support member through each of the at least one hole formed in the first and second flange portions.

21. The apparatus of claim 19, further comprising at least one guide protrusion formed on the receiving portion and oriented in an insertion and removal direction of the printed circuit board.

22. The apparatus of claim 21, wherein the at least one guide protrusion is configured to facilitate a sliding motion of the printed circuit board with respect to the support member.

23. The apparatus of claim 13, wherein the coupling device comprises:

at least one hole formed in opposite sides of the support member; and at least one fastener configured to be coupled to the support member through the at least one hole.

24. The apparatus of claim 23, wherein the fastener comprises a bolt.

25. The apparatus of claim 13, wherein the product comprises a refrigerator.

* * * * *